US011159879B2

(12) United States Patent
Chen et al.

(10) Patent No.: US 11,159,879 B2
(45) Date of Patent: Oct. 26, 2021

(54) FLEXIBLE GEOGRAPHICALLY-DISTRIBUTED DIFFERENTIAL MICROPHONE ARRAY AND ASSOCIATED BEAMFORMER

(71) Applicant: Northwestern Polytechnical University, Shanxi (CN)

(72) Inventors: Jingdong Chen, Shanxi (CN); Gongping Huang, Shanxi (CN); Jacob Benesty, Québec (CA)

(73) Assignee: Northwestern Polytechnical University, Shanxi (CN)

( * ) Notice: Subject to any disclaimer, the term of this patent is extended or adjusted under 35 U.S.C. 154(b) by 0 days.

(21) Appl. No.: 16/771,549

(22) PCT Filed: Jul. 16, 2018

(86) PCT No.: PCT/CN2018/095756

§ 371 (c)(1),
(2) Date: Jun. 10, 2020

(87) PCT Pub. No.: WO2020/014812

PCT Pub. Date: Jan. 23, 2020

(65) Prior Publication Data

US 2021/0185436 A1 Jun. 17, 2021

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2201/405* (2013.01); *H04R 2430/21* (2013.01)

(58) Field of Classification Search
CPC . H04R 3/00; H04R 3/04; H04R 3/005; H04R 2410/01; H04R 29/005; H04R 5/04; H04R 2430/21
(Continued)

(56) References Cited

U.S. PATENT DOCUMENTS 5,742,693 A * 4/1998 Elko ..... H04R 1/406 381/122
9,913,030 B2 * 3/2018 Bernardini ..... H04R 3/005
(Continued)

FOREIGN PATENT DOCUMENTS

CN 101852846 A 10/2010
CN 103329567 A 9/2013
WO 2018087590 A2 5/2018

OTHER PUBLICATIONS

International Search Report and Written Opinion dated Apr. 18, 2019 received in PCT/CN2018/095756, pp. 7.

*Primary Examiner* — Disler Paul
(74) *Attorney, Agent, or Firm* — Zhong Law, LLC

(57) ABSTRACT

A differential microphone array includes a plurality of microphones situated on a substantially planar platform and a processing device, communicatively coupled to the plurality of microphones, to receive a plurality of electronic signals generated by the plurality of microphones responsive to a sound source and execute a minimum-norm beamformer to calculate an estimate of the sound source based on the plurality of electronic signals, wherein the minimum-norm beamformer is determined subject to a constraint that an approximation of a beampattern associated with the differential microphone array substantially matches a target beampattern.

16 Claims, 5 Drawing Sheets

(58) Field of Classification Search
USPC ..... 381/91–92, 122
See application file for complete search history.

(56) References Cited

U.S. PATENT DOCUMENTS

| | | | | |
|---|---|---|---|---|
| 9,930,448 | B1 | 3/2018 | Chen et al. | |
| 2012/0327115 | A1 | 12/2012 | Chhetri et al. | |
| 2015/0163577 | A1 | 6/2015 | Benesty et al. | |
| 2017/0353790 | A1 | 12/2017 | Kim et al. | |
| 2018/0226086 | A1* | 8/2018 | Huang | H04R 1/406 |

* cited by examiner

FLEXIBLE GEOGRAPHICALLY-DISTRIBUTED DIFFERENTIAL MICROPHONE ARRAY AND ASSOCIATED BEAMFORMER

TECHNICAL FIELD

This disclosure relates to microphone arrays and, in particular, to a flexible geographically-distributed differential microphone array (FDMA) and the associated beamformer.

BACKGROUND

Beamformers (or spatial filters) are used in sensor arrays (e.g., microphone arrays) for directional signal transmission or reception. Each sensor in the sensor array may capture a version of a signal originating from a source signal. Each version of the signal may represent the source signal captured at a particular incident angle with respect to a reference point (e.g., a reference microphone location) at a particular time. The time may be recorded as a time delay with the reference point. The incident angle and the time delay are determined according to the geometry of the array sensor.

BRIEF DESCRIPTION OF THE DRAWINGS

The present disclosure is illustrated by way of example, and not by way of limitation, in the figures of the accompanying drawings.

DETAILED DESCRIPTION

Figure 1:
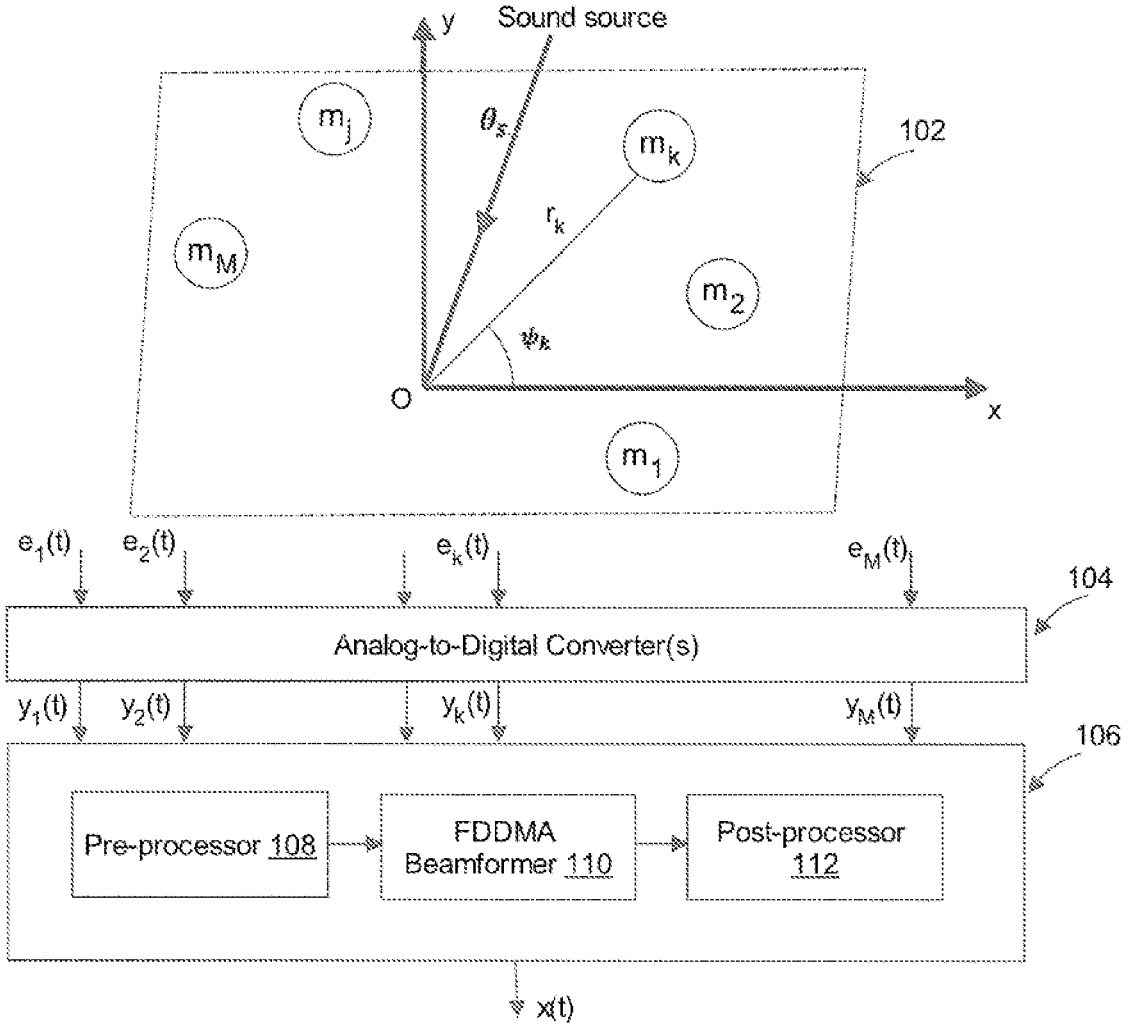
FIG. 1 illustrates a flexible geographically-distributed differential microphone array (FDMA) system according to an implementation of the present disclosure.

The captured versions of the signal may also include noise components. An array of analog-to-digital converters (ADCs) may convert the captured signals into a digital format (referred to as a digital signal). A processing device may implement a spatial filter (referred to as a beamformer) to calculate certain attributes of the source signal based on the digital signals.

The sensor can be a suitable type of sensors such as, for example, microphone sensors that capture sound signals. A microphone sensor may include a sensing element (e.g., a membrane) responsive to the acoustic pressure generated by sound waves arriving at the sensing element, and an electronic circuit to convert the acoustic pressures received by the sensing element into electronic currents. The microphone sensor can output electronic signals (or analog signals) to downstream processing devices for further processing. Each microphone sensor in a microphone array may receive a respective version of a sound signal emitted from a sound source at a distance from the microphone array. The microphone array may include a number of microphone sensors to capture the sound signals (e.g., speech signals) and convert the sound signals into electronic signals. The electronic signals may be converted by analog-to-digital converters (ADCs) into digital signals which may be further processed by a processing device (e.g., a digital signal processor (DSP)). Compared with a single microphone, the sound signals received at microphone arrays include redundancy that may be explored to calculate an estimate of the sound source to achieve certain objectives such as, for example, noise reduction/speech enhancement, sound source separation, de-reverberation, spatial sound recording, and source localization and tracking. The processed digital signals may be packaged for transmission over communication channels or converted back to analog signals using a digital-to-analog converter (DAC).

The microphone array can be communicatively coupled to a processing device (e.g., a digital signal processor (DSP) or a central processing unit (CPU)) that includes circuits programmed to implement a beamformer to calculate an estimate of the sound source. The sound signal received by any microphone sensor in the microphone array may include a noise component and a delayed component with respect to the sound signal received at a reference microphone sensor. A beamformer is a spatial filter that uses the multiple versions of the sound signal received at the microphone array to identify the sound source according to certain optimization rules.

The sound signal emitted from a sound source can be broadband signals such as, for example, speech and audio signals, typically in the frequency range from 20 Hz to 20 KHz. Some implementations of the beamformers are not effective in dealing with noise components at low frequencies because the beam-widths (i.e., the widths of the main lobes in the frequency domain) associated with the beamformers are inversely proportional to the frequency. To counter the non-uniform frequency response of beamformers, differential microphone arrays (DMAs) have been used to achieve frequency-invariant beam patterns and high directivity factors (DFs), where the DF describes sound intensity with respect to direction angles. DMAs may contain an array of microphone sensors that are responsive to the spatial derivatives of the acoustic pressure field. For example, the outputs of a number of geographically arranged omnidirectional sensors may be combined together to measure the differentials of the acoustic pressure fields among microphone sensors. Compared to additive microphone arrays, DMAs allow for small inter-sensor distance, and may be manufactured in a compact manner.

DMAs can measure the derivatives (at different orders) of the acoustic fields received by the microphones. For example, a first-order DMA, formed using the difference between a pair of adjacent microphones, may measure the first-order derivative of the acoustic pressure fields, and the second-order DMA, formed using the difference between a pair of adjacent first-order DMAs, may measure the second-order derivatives of acoustic pressure field, where the first-order DMA includes at least two microphones, and the second-order DMA includes at least three microphones. Thus, an N-th order DMA may measure the N-th order derivatives of the acoustic pressure fields, where the N-th order DMA includes at least N+1 microphones. The N-th order is referred to as the differential order of the DMA. The directivity factor of a DMA may increase with the order of the DMA.

In some implementations, the DMA may include a number of microphones arranged on a platform with well-defined geometrical shapes (i.e., shapes that can be specified by a geometric function). For example, sensor array can be a linear array where the sensors are arranged approximately along a linear platform (such as a straight line) or a circular array where the sensors are arranged approximately along a circular platform (such as a circle). These geometrical shapes can be specified by geometric functions (e.g., lines, circles, and ellipses). The beamformer may be designed based on the geometric functions.

As the cost microphones and the cost for the hardware to process signals captured by the microphone arrays become more affordable, the DMA are designed into a wide range of intelligent products to provide an interface with human users. Due to the restriction of the product designs, the microphones in a DMA can be placed at random locations rather than at locations according to geometric functions. For example, the microphones can be designed as part of decorative pieces whose locations are chosen based on aesthetic. Thus, the microphones may be distributed on a planar surface without following a well-defined geometric function (e.g., a line, a circle, or an ellipse). Current implementations of DMAs and their associated beamformers are directed to microphones arranged according to certain geometric functions such as lines and circles, thus preventing DMA arrays from being used in a broader range of products.

To overcome the above-identified and other deficiencies, implementations of the present disclosure provide a technical solution that may include beamformers for DMAs including microphones at flexible geographically-distributed locations (referred to as flexible DMA or FDMA). In one implementation, the microphones of the FDMAs may be located at any positions on a planar surface as long as the locations of the microphones are known. The beam pattern associated with a DMA is represented by an approximation including a series of harmonics (e.g., using the Jacobi-Anger expansion). The beamformer for the FDMA is constructed based on the approximate representation. In this way, implementations of the disclosure may achieve beamforming for DMAs including microphones at flexible locations.

FIG. 1 illustrates a FDMA system 100 according to an implementation of the present disclosure. As shown in FIG. 1, system 100 may include a FDMA 102, an analog-to-digital converter (ADC) 104, and a processing device 106. FDMA 102 may include flexible geographically-distributed microphones ($m_0, m_1, \ldots, m_k, \ldots, m_M$) that are arranged on a common plenary platform. These microphones can be located at any locations on the plenary platform. The locations of these microphones may be specified with respect to a coordinate system (x, y).

As shown in FIG. 1, the microphone sensors in microphone array 102 may receive acoustic signals originated from a sound source from an incident direction $\theta_s$. In one implementation, the acoustic signal may include a first component from a sound source (s(t)) and a second noise component (v(t)) (e.g., ambient noise), wherein t is the time. Due to the spatial distance between microphone sensors, each microphone sensor may receive a different version of the sound signal (e.g., with different amount of delays with respect to a reference point, where the reference point can be another microphone.

Figure 2:
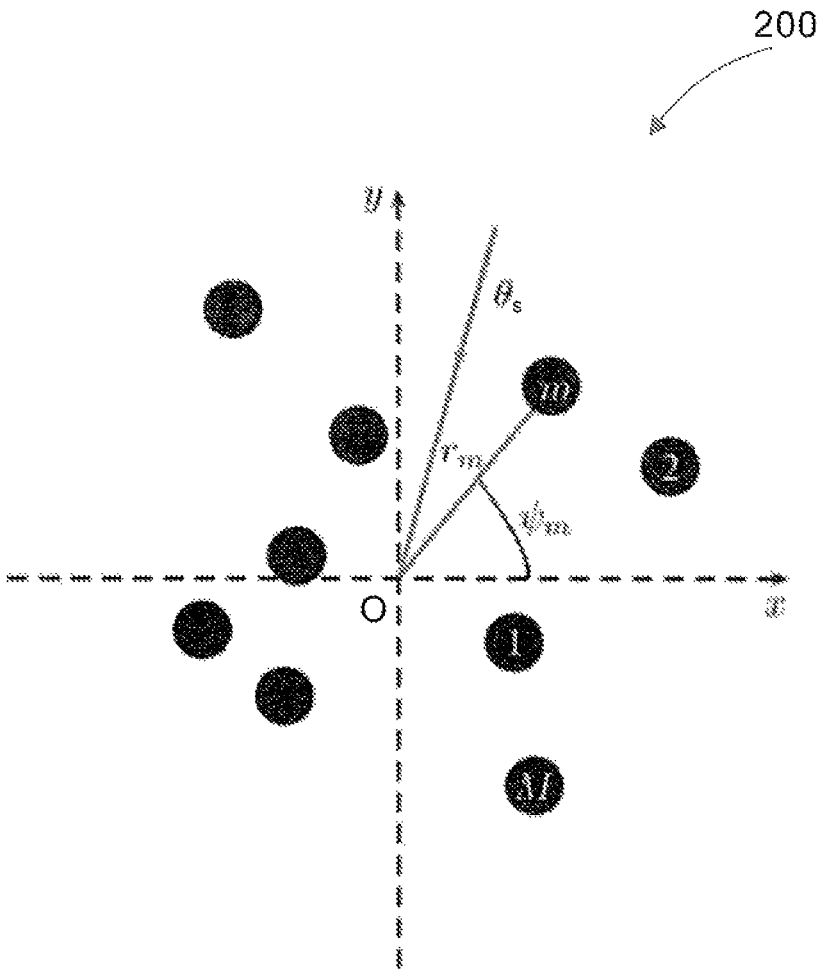
FIG. 2 shows a detailed arrangement of a flexible geographically-distributed differential microphone array (FDMA) according to an implementation of the present disclosure.

FIG. 2 illustrates a detailed arrangement of a flexible geographically-distributed differential microphone array (FDMA) 200 according to an implementation of the present disclosure. FDMA 200 may include a number (M) of omni-directional microphones distributed within an area in a two-dimensional Cartesian coordinate system (x, y). The coordinate system may include an origin (O) to which the microphone locations may be specified. The coordinates of the microphones can be specified as:

$$r_m = r_m[\cos(\psi_m)\sin(\psi_m)]^T,$$

with m=1, 2, . . . , M, where the superscript T is the transpose operator, $r_m$ represents the distance from the $m^{th}$ microphone to the origin, and $\psi_m$ represents the angular position of the $m^{th}$ microphone. The distance between microphone i and microphone j is then $$\delta_{ij} = \|r_i - r_j\|,$$

where i, j=1, 2, . . . , M, and ||•|| is the Euclidean norm. It is assumed that the maximum distance between two microphones is smaller than the wavelength (λ) of the sound wave. Assuming that the source signal is a plane wave from a far-field, propagating in an anechoic acoustic environment at the speed of the sound (c=340 m/s), and impinges on FDMA 200. The incident direction of the source signal to FDMA 200 is the azimuthal angle $\theta_s$. The time delay between the $m^{th}$ microphone and the reference point (O) can be written as:

$$\tau_m(\theta_s) = \frac{r_m}{c}\cos(\theta_s - \psi_m),$$

where m=1, 2, . . . , M.

FDMA 200 may be associated with a steering vector that characterizes FDMA 200. The steering vector may represent the relative phase shifts for the incident far-field waveform across the microphones in FDMA 200. Thus, the steering vector is the response of FDMA 200 to an impulse input. With the model of FDMA 200 as described above, the steering vector can be defined as:

$$d(\omega,\theta_s) = [e^{j\omega\tau_1(\theta_s)} \ldots e^{j\omega\tau_2(\theta_s)} \ldots e^{j\omega\tau_M(\theta_s)}]^T,$$

where the superscript T is the transpose operator, j is the imaginary unit with $j^2=-1$, $\omega=2\pi f$ is the angular frequency, and f>0 is the temporal frequency.

Referring to FIG. 1, each microphone may receive a version of an acoustic signal $a_k(t)$ that may include a delayed copy of the sound source represented as $s(t+d_k)$ and a noise component represented as $v_k(t)$, wherein t is the time, k=1, . . . , M, $d_k$ is the time delay for the acoustic signal received at microphone $m_k$ to a reference point, and $v_k(t)$ represents the noise component at microphone $m_k$. The electronic circuit of microphone $m_k$ of FDMA 102 may convert $a_k(t)$ into electronic signals $e_k(t)$ that may be fed into the ADC 104, wherein k=1, . . . , M. In one implementation, the ADC 104 may further convert the electronic signals $e_k(t)$ into digital signals $y_k(t)$. The analog to digital conversion may include quantization of the input $e_k(t)$ into discrete values $y_k(t)$.

In one implementation, the processing device 106 may include an input interface (not shown) to receive the digital signals $y_k(t)$, and as shown in FIG. 1, the processing device may be programmed to identify the sound source by a FDMA beamformer 110. To execute FDMA beamformer 110, in one implementation, the processing device 106 may implement a pre-processor 108 that may further process the digital signal $y_k(t)$ for FDMA beamformer 110. The pre-processor 108 may include hardware circuits and software programs to convert the digital signals $y_k(t)$ into frequency domain representations using such as, for example, short-time Fourier transforms (STFT) or any suitable type of frequency transformations. The STFT may calculate the Fourier transform of its input signal over a series of time frames. Thus, the digital signals $y_k(t)$ may be processed over the series of time frames.

In one implementation, the pre-processing module 108 may perform STFT on the input $y_k(t)$ associated with microphone $m_k$ of FDMA 102 and calculate the corresponding frequency domain representation $Y_k(\omega)$, wherein $\omega$ ($\omega=2\pi f$) represents the angular frequency domain, k=1, . . . , M. In one implementation, FDMA beamformer 110 may receive frequency representations $Y_k(\omega)$ of the input signals $y_k(t)$ and calculate an estimate $Z(\omega)$ in the frequency domain for the sound source (s(t)). In one implementation, the frequency domain may be divided into a number (L) of frequency sub-bands, and the FDMA beamformer 110 may calculate the estimate $Z(\omega)$ for each of the frequency sub-bands.

The processing device 106 may also include a post-processor 112 that may convert the estimate $Z(\omega)$ for each of the frequency sub-bands back into the time domain to provide the estimate sound source represented as x(t). The estimated sound source x(t) may be determined with respect to the source signal received at a reference point in FDMA 102.

Implementations of the present disclosure may include different types of FDMA beamformers 110 that can be used to calculate the estimated sound source x(t) using the acoustic signals captured by FDMA 102. The performance of the different types of beamformers may be measured in terms of signal-to-noise ratio (SNR) gain and a directivity factor (DF) measurement. The SNR gain is defined as the signal-to-noise ratio at the output (oSNR) of FDMA 102 compared to the signal-to-noise ratio at the input (iSNR) of FDMA 102. When each of microphones $m_k$ is associated with white noise including substantially identical temporal and spatial statistical characteristics (e.g., substantially the same variance), the SNR gain is referred to as the white noise gain (WNG). This white noise model may represent the noise generated by the hardware elements in the microphone itself. Environmental noise (e.g., ambient noise) may be represented by a diffuse noise model. In this scenario, the coherence between the noise at a first microphone and the noise at a second microphone is a function of the distance between these two microphones.

The SNR gain for the diffuse noise model is referred to as the directivity factor (DF) associated with FDMA 102. The DF quantifies the ability of the beamformer in suppressing spatial noise from directions other than the look direction. The DF associated with FDMA 102 may be written as:

$$D[h(\omega)] = \frac{|h^H(\omega)d(\omega, \theta_s)|^2}{h^H(\omega)\Gamma_d(\omega)h(\omega)},$$

where $h(\omega)=[H_1(\omega)\ H_2(\omega) \ldots H_m(\omega)]^T$ is the global filter for the beamformer associated with FDMA 102, and the superscript H represents the conjugate-transpose operator, and $[H_1(\omega)\ H_1(\omega)\ \ldots\ H_M(\omega)]^T$ are the spatial filter of M microphones, and where $\Gamma_d(\omega)$ is the pseudo-coherence matrix of the noise signal in a diffuse (spherically isotropic) noise field, and the (i, j)th element of $\Gamma_d(\omega)$ is $$|\Gamma_d(\omega)|_{ij} = \sin\left(\frac{\omega\delta_{ij}}{c}\right).$$

Additionally, FDMA 102 may be associated with a beampattern (or directivity pattern) that reflects the sensitivity of the beamformer to a plane wave impinging on FDMA 102 from a certain angular direction $\theta$. The beampattern for a plane wave impinging from an angle $\theta$ for a beamformer represented by a filter $h(\omega)$ associated with FDMA 102 can be defined as $$B[h(\omega), \theta] = h^H(\omega)d(\omega, \theta) = \sum_{k=1}^{M} H_k^*(\omega)d^{\frac{\omega\tau_k}{c}(\theta-\psi_k)}$$

where $h(\omega)=[H_1(\omega)\ H_2(\omega) \ldots H_m(\omega)]^T$ is the global filter for the beamformer associated with FDMA 102, and the superscript H represents the conjugate-transpose operator, and $[H_1(\omega)\ H_1(\omega)\ \ldots\ H_M(\omega)]^T$ are the spatial filter of M microphones.

The objective of beamforming is to parameterize the global filter $h(\omega)$ so that the beam pattern $B[h(\omega),\theta]$ substantially matches a target beampattern. The target beampattern is the one when the performance of the DMA is at the best in terms of the DF and WNG. For example, in a linear DMA, the best performance may be achieved when the plane sound wave is at the endfire direction or parallel to the main axis (i.e., $\theta=0$) of the linear platform. For FDMA 102 where microphones are distributed at arbitrary locations on a plane, the main beam is no long aligned with the main axis. Instead, for FDMA 102, the objective is to steer the beampattern to the angle $\theta_s$ which is the incident angle of the sound signal. The corresponding target frequency-invariant beampattern can be written as $B(a_N, \theta-\theta_s)=\Sigma_{n=0}^{N} a_{N,n} \cos(n(\theta-\theta_s))$, where $a_{N,n}$ are the real coefficients that determines the different directivity patterns of the Nth-order FDMA 102. The $B(a_N, \theta-\theta_s)$ may be rewritten as:

$$B(b_{2N},\theta-\theta_s)=\Sigma_{n=-N}^{N} b_{2N,n}e^{jn(\theta-\theta_s)}=[Y(\theta_s)b_{2N}]^T P_e(\theta)=c_{2N}^T(\theta_s)P_e(\theta),$$

where $b_{2N,0}=a_{N,0}, b_{2N,i}=\frac{1}{2}a_{N,i}$, $i=\pm1, \pm2, \ldots, \pm N$, $$Y(\theta_s)=\mathrm{diag}(e^{jN\theta_s}, \ldots, 1, \ldots, e^{-jN\theta_s})$$

is a $(2N+1)\times(2N+1)$ diagonal matrix and $$b_{2N}=[b_{2N,-N} \ldots b_{2N,0} \ldots b_{2N,N}]^T,$$

$$P_e(\theta)=[e^{-jN\theta} \ldots 1 \ldots e^{jN\theta}]^T,$$

$$c_{2n}(\theta_s)=Y(\theta_s)b_{2N}=[c_{2N,-N}(\theta_s) \ldots c_{2N,0}(\theta_s) \ldots c_{2N,N}(\theta_s)]^T,$$

are vectors of length 2N+1, respectively. The main beam points in the direction of $\theta_s$ and $B(b_{2N},\theta-\theta_s)$ is symmetric with respect to the axis $\theta_s \leftrightarrow \theta_s+\pi$.

As such, the designed beampattern $B[h(\omega),\theta]$ after applying the beamforming filter $h(\omega)$ should substantially match the target beampattern $B(b_{2N},\theta-\theta_s)$. To achieve this objective, $$e^{j\frac{\omega\tau_k}{c}(\theta-\psi_k)}$$

may be approximated using an $N^{th}$ order Jacobi-Anger expansion, i.e., $$e^{j\frac{\omega r_k}{c}(\theta-\psi_k)} \approx \sum_{n=-N}^{N} j^n J_n\left(\frac{\omega r_k}{c}\right) e^{jn(\theta-\psi_k)},$$

where $J_n(x)$ is the nth-order Bessel function of the first kind. Using the above Jacobi-Anger expansion, the beampattern for the beamformer may be written as:

$$[h(\omega), \theta] = \sum_{n=-N}^{N} e^{jn\theta} j^n \psi_n^T(\omega) h^*(\omega),$$

$$\text{where } \psi_n(\omega) = \left[J_n\left(\frac{\omega r_1}{c}\right)e^{-jn\psi_1} J_n\left(\frac{\omega r_2}{c}\right)e^{-jn\psi_2} \ldots J_n\left(\frac{\omega r_M}{c}\right)e^{-jn\psi_M}\right]^T$$

is a vector of length M. Based on the representation of Jacobi-Anger expansion, it follows that $$\Psi(\omega)h(\omega) = \Upsilon(\theta_s)b_{2N},$$

where $$\Psi(\omega) = \begin{bmatrix} (-j)^N \psi_{-N}^H(\omega) \\ \vdots \\ \psi_0^H(\omega) \\ \vdots \\ (-j)^N \psi_N^H(\omega) \end{bmatrix}$$

is a (2N+1)×M matrix.

The beamforming filter h(ω) can be derived using a minimum-norm method:

$$\min_{h(\omega)} h^T(\omega)h(\omega), \text{ subject to } \Psi(\omega)h(\omega)=\Upsilon^*(\theta_s)b_{2N},$$

whose solution can be $$h(\omega)=\Psi^H(\omega)[\Psi(\omega)\Psi^H(\omega)]^{-1}\Upsilon^*(\theta_s)b_{2N}.$$

Thus, a beamforming filter may be achieved for FDMA 102 what includes geographically-distributed microphones at flexible locations. The locations of microphones of FDMA 102 are not limited to certain geometric functions such as, for example, lines or circles.

Figure 3:
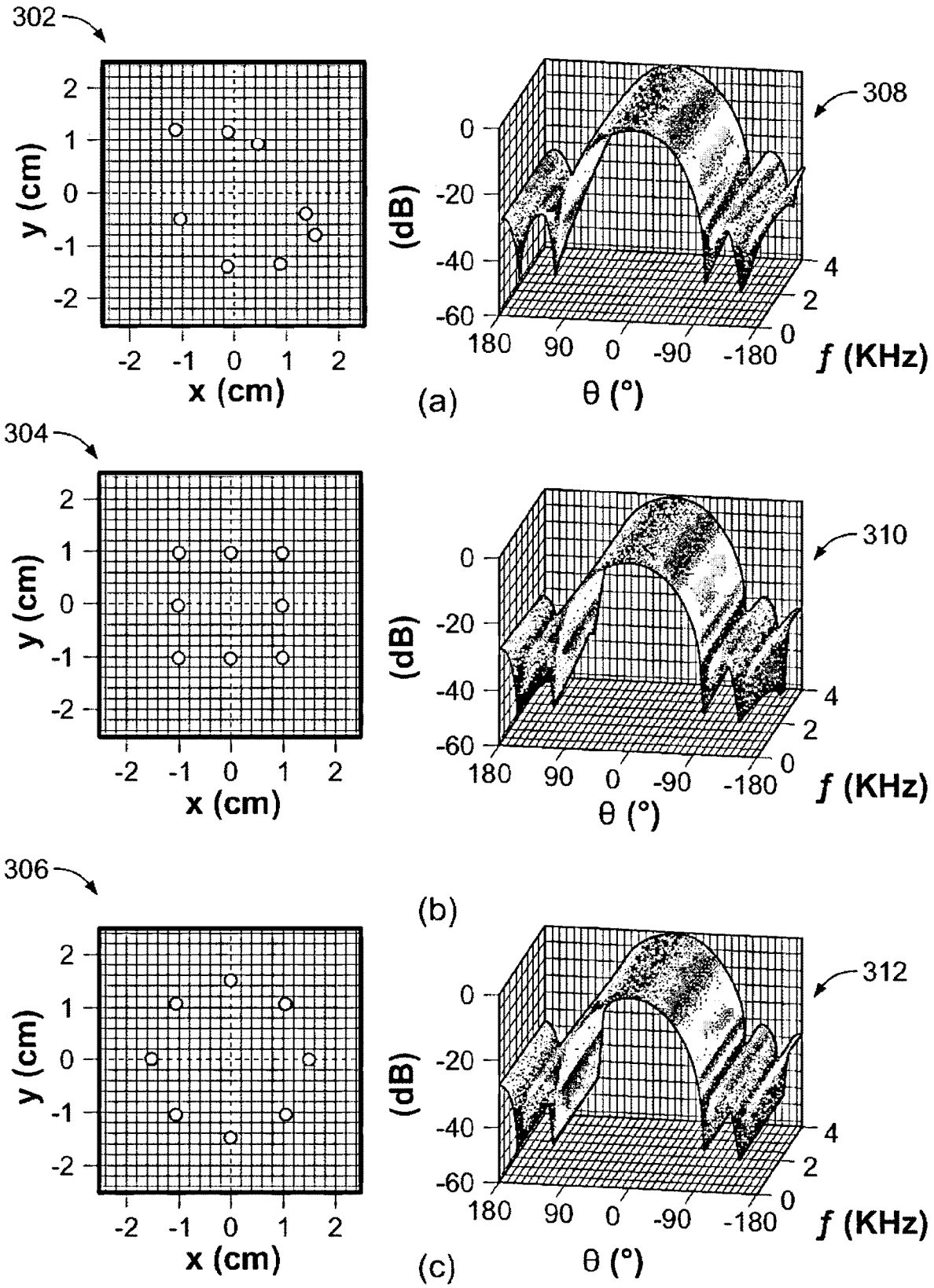
FIG. 3 three microphone arrays and their corresponding beampatterns according an implementation of the present disclosure.

Experiments have shown that FDMA beamformers designed as described above can generate beampatterns that substantially match the target beampattern. FIG. 3 illustrates three microphone arrays and their corresponding beampatterns according to an implementation of the present disclosure. As shown in FIG. 3, each of microphone arrays 302, 304, 306 may contain eight microphones. Microphone array 302 (Array-I) includes eight microphones at random locations; microphone array 304 (Array-II) includes a uniform rectangular microphone array, where the microphones are uniformly distributed on four sides of the rectangle; microphone array 306 (Array-III) includes a uniform circular microphone array. Without loss of generality, it is assumed that the look direction is 0° or $\theta_s$=0°.

The target (or desired) beampattern can be a second-order hypercardioid whose coefficients are $$a_N = \left[\frac{1}{5}\frac{2}{5}\frac{2}{5}\right]^T \text{ and } b_{2N} = \left[\frac{1}{5}\frac{1}{5}\frac{1}{5}\frac{1}{5}\frac{1}{5}\right]^T.$$

For the microphone arrays 302, 304, 306, implementation may construct minimum-norm filters with the beampattern constraints as described above. The beampatterns for the FDMAs are shown in 308, 310, 312. As shown, implementations of the disclosure may successfully form the second-order hypercardioid for all of the three microphone arrangements including microphones at random locations. Further, the beampatterns are substantially frequency-invariant.

Figure 4:
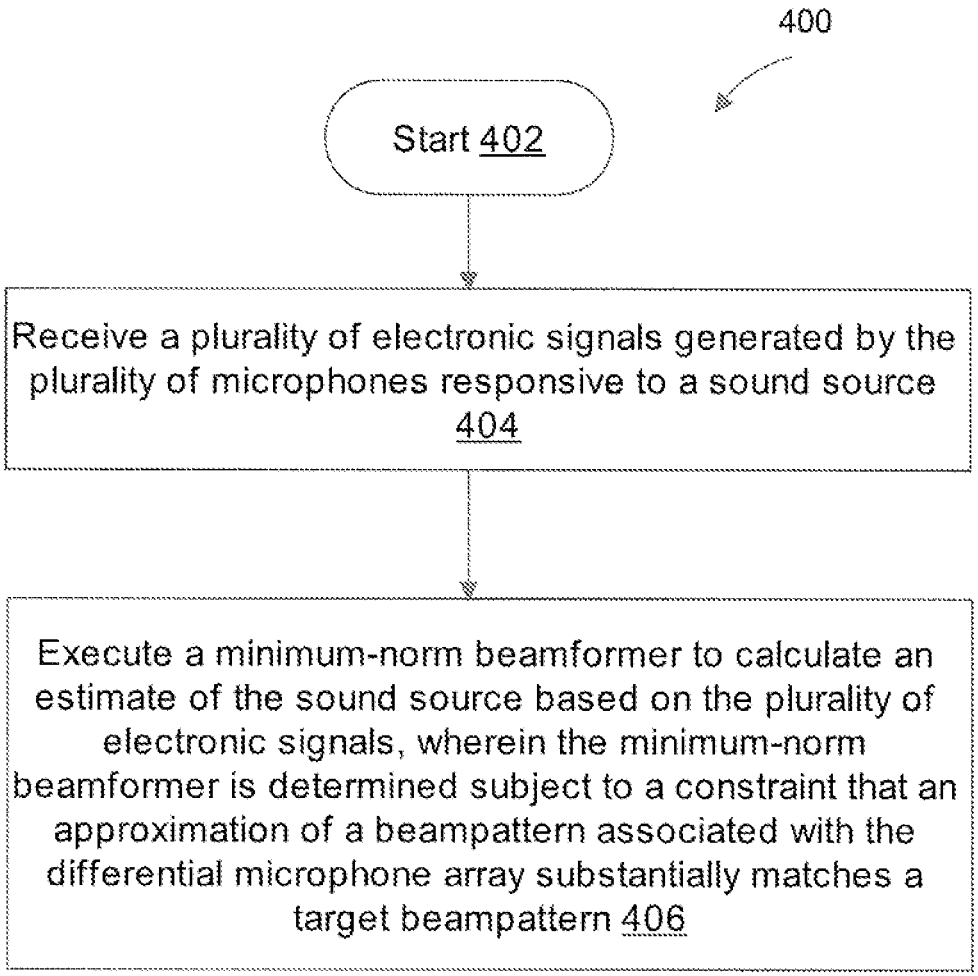
FIG. 4 is a flow diagram illustrating a method to estimate a sound source using a beamformer associated with a flexible geographically-distributed differential microphone array (FDMA) according to some implementations of the disclosure.

FIG. 4 is a flow diagram illustrating a method 400 to estimate a sound source using a beamformer associated with a flexible geographically-distributed differential microphone array (FDMA) according to some implementations of the disclosure. The method 400 may be performed by processing logic that comprises hardware (e.g., circuitry, dedicated logic, programmable logic, microcode, etc.), software (e.g., instructions run on a processing device to perform hardware simulation), or a combination thereof.

For simplicity of explanation, methods are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter. In addition, the methods could alternatively be represented as a series of interrelated states via a state diagram or events. Additionally, it should be appreciated that the methods disclosed in this specification are capable of being stored on an article of manufacture to facilitate transporting and transferring such methods to computing devices. The term article of manufacture, as used herein, is intended to encompass a computer program accessible from any computer-readable device or storage media. In one implementation, the methods may be performed by the beamformer 110 executed on the processing device 106 as shown in FIG. 1.

Referring to FIG. 4, at 402, the processing device may start executing operations to calculate an estimate for a sound source such as a speech source. The sound source may emit sound that may be received by a microphone array including geographically-distributed microphones that may convert the sound into sound signals. The sound signals may be electronic signals including a first component of the sound and a second component of noise. Because the microphone sensors are commonly located on a planar platform and are separated by spatial distances, the first components of the sound signals may vary due to the temporal delays of the sound arriving at the microphone sensors.

At 404, the processing device may receive the electronic signals from the FDMA in response to the sound. The microphones in the FDMA may be located on a substantial plane and include a total number (M) of microphones. The locations of these microphones are specified according to a coordinate system.

At 406, the processing device may execute a minimum-norm beamformer to calculate an estimate of the sound source based on the plurality of electronic signals, in which the minimum-norm beamformer is determined subject to a constraint that an approximation of a beampattern associated with the differential microphone array substantially matches a target beampattern.

Figure 5:
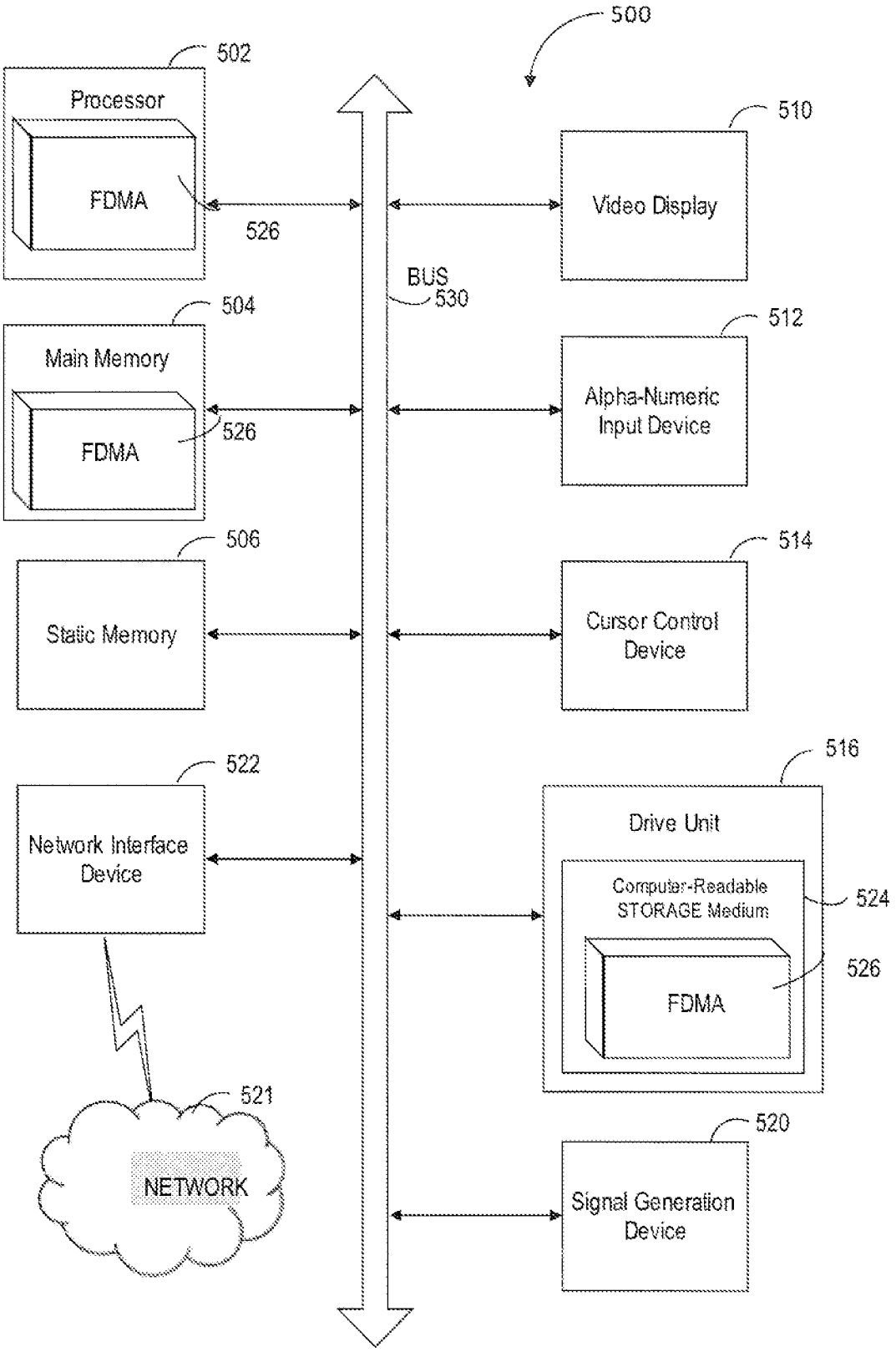
FIG. 5 is a block diagram illustrating an exemplary computer system, according to some implementations of the present disclosure.

FIG. 5 illustrates a diagrammatic representation of a machine in the exemplary form of a computer system 500 within which a set of instructions for causing the machine to perform any one or more of the methodologies discussed herein, may be executed. In alternative implementations, the machine may be connected (e.g., networked) to other machines in a LAN, an intranet, or the Internet. The machine may operate in the capacity of a server or a client machine in a client-server network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 500 includes a processing device (processor) 502, a main memory 504 (e.g., read-only memory (ROM), flash memory, dynamic random access memory (DRAM) such as synchronous DRAM (SDRAM) or Rambus DRAM (RDRAM), etc.), a static memory 506 (e.g., flash memory, static random access memory (SRAM), etc.), and a data storage device 518, which communicate with each other via a bus 508.

Processor 502 represents one or more general-purpose processing devices such as a microprocessor, central processing unit, or the like. More particularly, the processor 502 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processor 502 may also be one or more special-purpose processing devices such as an application specific integrated circuit (ASIC), a field programmable gate array (FPGA), a digital signal processor (DSP), network processor, or the like. The processor 502 is configured to execute instructions 526 for performing the operations and steps discussed herein.

The computer system 500 may further include a network interface device 522. The computer system 500 also may include a video display unit 510 (e.g., a liquid crystal display (LCD), a cathode ray tube (CRT), or a touch screen), an alphanumeric input device 512 (e.g., a keyboard), a cursor control device 514 (e.g., a mouse), and a signal generation device 520 (e.g., a speaker).

The data storage device 518 may include a computer-readable storage medium 524 on which is stored one or more sets of instructions 526 (e.g., software) embodying any one or more of the methodologies or functions described herein (e.g., processing device 102). The instructions 526 may also reside, completely or at least partially, within the main memory 504 and/or within the processor 502 during execution thereof by the computer system 500, the main memory 504 and the processor 502 also constituting computer-readable storage media. The instructions 526 may further be transmitted or received over a network 574 via the network interface device 522.

While the computer-readable storage medium 524 is shown in an exemplary implementation to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present disclosure. The term "computer-readable storage medium" shall accordingly be taken to include, but not be limited to, solid-state memories, optical media, and magnetic media.

In the foregoing description, numerous details are set forth. It will be apparent, however, to one of ordinary skill in the art having the benefit of this disclosure, that the present disclosure may be practiced without these specific details. In some instances, well-known structures and devices are shown in block diagram form, rather than in detail, in order to avoid obscuring the present disclosure.

Some portions of the detailed description have been presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "segmenting", "analyzing", "determining", "enabling", "identifying," "modifying" or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The disclosure also relates to an apparatus for performing the operations herein. This apparatus may be specially constructed for the required purposes, or it may include a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

Reference throughout this specification to "one implementation" or "an implementation" means that a particular feature, structure, or characteristic described in connection with the implementation is included in at least one implementation. Thus, the appearances of the phrase "in one implementation" or "in an implementation" in various places throughout this specification are not necessarily all referring to the same implementation. In addition, the term "or" is intended to mean an inclusive "or" rather than an exclusive "or."

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A differential microphone array comprising:

a plurality of microphones located on a substantially planar platform; and a processing device, communicatively coupled to the plurality of microphones, to:

receive a plurality of electronic signals generated by the plurality of microphones responsive to a sound source; and execute a minimum-norm beamformer to calculate an estimate of the sound source based on the plurality of electronic signals, wherein the minimum-norm beamformer is determined subject to a constraint that an approximation of a beampattern associated with the differential microphone array substantially matches a target beampattern, wherein the approximation of the beampattern associated with the differential microphone array comprises a plurality of exponential components that each corresponds to a respective one of the plurality of microphones, and wherein each one of the plurality of exponential components is approximated by a corresponding Jacobi-Anger series to a pre-determined order.

2. The differential microphone array of claim 1, wherein each one of the plurality of electronic signals represents a respective version of the sound source received at a corresponding one of the plurality of microphones.

3. The differential microphone array of claim 1, further comprising:

an analog-to-digital converter, communicatively coupled to the plurality of microphones and the processing device, to convert the plurality of electronic signals into a plurality of digital signals.

4. The differential microphone array of claim 1, wherein the plurality of microphones are geographically-distributed at locations specified with respect to a reference point in a coordinate system on the substantially planar platform.

5. The differential microphone array of claim 1, wherein the target beampattern is associated with an incident angle of the sound source.

6. A system comprising:

a data store; and a processing device, communicatively coupled to the data store, to:

receive a plurality of electronic signals generated by a differential microphone array comprising a plurality of microphones responsive to a sound source, wherein the plurality of microphones are situated on a substantially planar platform; and execute a minimum-norm beamformer to calculate an estimate of the sound source based on the plurality of electronic signals, wherein the minimum-norm beamformer is determined subject to a constraint that an approximation of a beampattern associated with the differential microphone array substantially matches a target beampattern, wherein the approximation of the beampattern associated with the differential microphone array comprises a plurality of exponential components that each corresponds to a respective one of the plurality of microphones, and wherein each one of the plurality of exponential components is approximated by a corresponding Jacobi-Anger series to a pre-determined order.

7. The system of claim 6, wherein each one of the plurality of electronic signals represents a respective version of the sound source received at a corresponding one of the plurality of microphones.

8. The system of claim 6, wherein the plurality of microphones are geographically-distributed at locations specified with respect to a reference point in a coordinate system on the substantially planar platform.

9. The system of claim 6, wherein the target beampattern is associated with an incident angle of the sound source.

10. A method comprising:

receiving, by a processing device, a plurality of electronic signals generated by a differential microphone array comprising a plurality of microphones responsive to a sound source, wherein the plurality of microphones are situated on a substantially planar platform; and executing a minimum-norm beamformer to calculate an estimate of the sound source based on the plurality of electronic signals, wherein the minimum-norm beamformer is determined subject to a constraint that an approximation of a beampattern associated with the differential microphone array substantially matches a target beampattern, wherein the approximation of the beampattern associated with the differential microphone array comprises a plurality of exponential components that each corresponds to a respective one of the plurality of microphones, and wherein each one of the plurality of exponential components is approximated by a corresponding Jacobi-Anger series to a pre-determined order.

11. The method of claim 10, wherein each one of the plurality of electronic signals represents a respective version of the sound source received at a corresponding one of the plurality of microphones.

12. The method of claim 10, wherein the plurality of microphones are geographically-distributed at locations specified with respect to a reference point in a coordinate system on the substantially planar platform.

13. The method of claim 10, wherein the target beampattern is associated with an incident angle of the sound source.

14. A non-transitory machine-readable storage medium storing instructions which, when executed, cause a processing device to:

receive, by the processing device, a plurality of electronic signals generated by a differential microphone array comprising a plurality of microphones responsive to a sound source, wherein the plurality of microphones are situated on a substantially planar platform; and execute a minimum-norm beamformer to calculate an estimate of the sound source based on the plurality of electronic signals, wherein the minimum-norm beamformer is determined subject to a constraint that an approximation of a beampattern associated with the differential microphone array substantially matches a target beampattern, wherein the approximation of the beampattern associated with the differential microphone array comprises a plurality of exponential components that each corresponds to a respective one of the plurality of microphones, and wherein each one of the plurality of exponential components is approximated by a corresponding Jacobi-Anger series to a pre-determined order.

15. The non-transitory machine-readable storage medium of claim 14, wherein each one of the plurality of electronic signals represents a respective version of the sound source received at a corresponding one of the plurality of microphones.

16. The non-transitory machine-readable storage medium of claim 14, wherein the target beampattern is associated with an incident angle of the sound source.

* * * * *